US008071923B2

(12) United States Patent
McMahan

(10) Patent No.: US 8,071,923 B2
(45) Date of Patent: Dec. 6, 2011

(54) DEVICE FOR MICROWAVE HEATING OF A FOOD PRODUCT

(75) Inventor: Steven A McMahan, Flushing, MI (US)

(73) Assignee: McMahan Enterprises, LLC, Flushing, MI (US)

( * ) Notice: Subject to any disclaimer, the term of this patent is extended or adjusted under 35 U.S.C. 154(b) by 0 days.

(21) Appl. No.: 12/530,924

(22) PCT Filed: Jun. 15, 2007

(86) PCT No.: PCT/US2007/014017

§ 371 (c)(1), (2), (4) Date: Sep. 11, 2009

(87) PCT Pub. No.: WO2008/100271

PCT Pub. Date: Aug. 21, 2008

(65) Prior Publication Data

US 2010/0108668 A1 May 6, 2010

Related U.S. Application Data

(60) Provisional application No. 60/902,024, filed on Feb. 15, 2007.

(51) Int. Cl.
*H05B 6/80* (2006.01)

(52) U.S. Cl. ..... 219/725; 219/734; 426/87

(58) Field of Classification Search ..... 219/725, 219/731, 733, 734; 426/394, 397, 402, 403, 426/412; 220/657, 656, 658, 659
See application file for complete search history.

(56) References Cited

U.S. PATENT DOCUMENTS

| | | | | |
|---|---|---|---|---|
| 4,803,088 | A | 2/1989 | Yamamoto et al. | |
| 4,870,233 | A | 9/1989 | McDonald et al. | |
| 5,352,465 | A * | 10/1994 | Gondek et al. | 426/87 |
| 5,519,195 | A | 5/1996 | Keefer et al. | |
| 5,695,673 | A | 12/1997 | Geissler | |
| 6,097,017 | A | 8/2000 | Pickford | |
| 6,486,455 | B1 * | 11/2002 | Merabet | 219/725 |
| 6,672,473 | B2 * | 1/2004 | Torniainen et al. | 220/657 |
| 6,833,534 | B2 | 12/2004 | Bellassai et al. | |
| 6,886,694 | B2 | 5/2005 | McNeeley et al. | |
| 6,952,000 | B2 * | 10/2005 | Ohyama | 219/734 |
| 6,973,870 | B2 | 12/2005 | Alves | |
| 7,090,090 | B2 | 8/2006 | Ohyama | |
| 2006/0191935 | A1 | 8/2006 | Tuszkiewicz et al. | |

* cited by examiner

*Primary Examiner* — Quang Van
(74) *Attorney, Agent, or Firm* — Stephen T. Mahan

(57) ABSTRACT

A container 10 for use in a microwave oven for heating a food product includes a base 20 that is substantially rectangularly shaped and includes a lower ledge 22, and a sump 30. First sides 24, and ends 26, extend upwardly from the base. An upper ledge 28, annular to a periphery formed at a top of the first sides and ends extend outwardly therefrom. Second sides 32 extend upwardly from a periphery of the upper ledge substantially perpendicular to a planar surface defined by the base. Outwardly extending flange 40 is formed annular to and along a periphery of the second sides.

16 Claims, 5 Drawing Sheets

DEVICE FOR MICROWAVE HEATING OF A FOOD PRODUCT

CROSS-REFERENCE TO RELATED APPLICATIONS

This application claims priority from U.S. Provisional Application No. 60/902,024, filed Feb. 15, 2007, entitled DEVICE AND METHOD FOR MICROWAVE COOKING OF A FOOD PRODUCT.

TECHNICAL FIELD

The present invention relates to a container for use in a microwave cooking oven, to heat and cook pasta and other foodstuffs.

BACKGROUND ART

Microwave ovens are able to effectively heat and cook a wide variety of food stuffs. One exception has been food products that require cooking in a liquid, e.g., pasta cooked in water. Cooking of pasta, especially spaghetti, typically requires stirring of the pasta, and frequent oversight to prevent foam from boiling over edges of the cooking pan.

Cooking pasta is frequently associated with the traditional "stove top" cooking that requires multiple large cooking utensils that are typically round and require human interactions throughout the pasta cooking process which is, add water and wait for the water to boil, add the pasta and stir occasionally until the water starts boiling again, occasionally stir the pasta and test pasta texture until cooked and then strain the pasta. Traditional "Stove-top" method for cooking pasta is described by 1) Filling a large pot with water, 2) Place on stove and wait for the water to boil, 3) Add pasta to boiling water and wait until pasta softens, 4) Stir pasta and wait for water to boil. 5) Continue to stir the pasta and check texture until cooked, 6) Place strainer in sink, 7) Carry the large pot filled with the boiling water and drain pasta into the strainer.

After cooking the pasta the food preparer has multiple large cooking utensils to wash that make cleanup burdensome. Consumer preference, however, is to cook the pasta in one small container, using less amounts of water and energy in less time and without the need for human interaction during the cooking process. After cooking the pasta the food preparer would prefer to wash one small container in an automatic dishwasher rather than hand-cleaning several large cooking utensils.

Multipurpose microwave food containers are intended to reheat and cook a variety of processed or precooked foods or chilled or frozen foods. Multipurpose microwave food containers lack geometric and physical features that meet the cooking requirements and physical size of elongated pasta noodles such as spaghetti, linguini, fettucini, or lasagna. The physical shape of multipurpose food containers cannot contain elongated pasta noodles without breaking or cutting the pasta to fit the multipurpose food container shape. Multipurpose microwave food containers lack the geometric features to control the boiling of water in a manner to agitate the noodles during the cooking process, still requiring the food preparer to periodically stir the pasta while the pasta is being cooked.

Therefore, there is a need for a device that effectively cooks pasta in a microwave oven which addresses the concerns described hereinabove.

DISCLOSURE OF THE INVENTION

The present invention overcomes the problems associated with the prior art by providing a container for use in a microwave oven. The container 10 comprises a base 20 that is substantially rectangularly shaped and comprises a lower ledge 22, and, a sump 30. There are first sides 24, and ends 26, extending upwardly from the base. There is an upper ledge 28, annular to a periphery formed at a top of the first sides and ends and extending outwardly therefrom. There are second sides 32, extending upwardly from a periphery of the upper ledge and substantially perpendicular to a planar surface defined by the base. There is an outwardly extending flange 40, formed annular to and along a periphery of the second side portions.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

MODES FOR CARRYING OUT THE INVENTION

Figure 1:
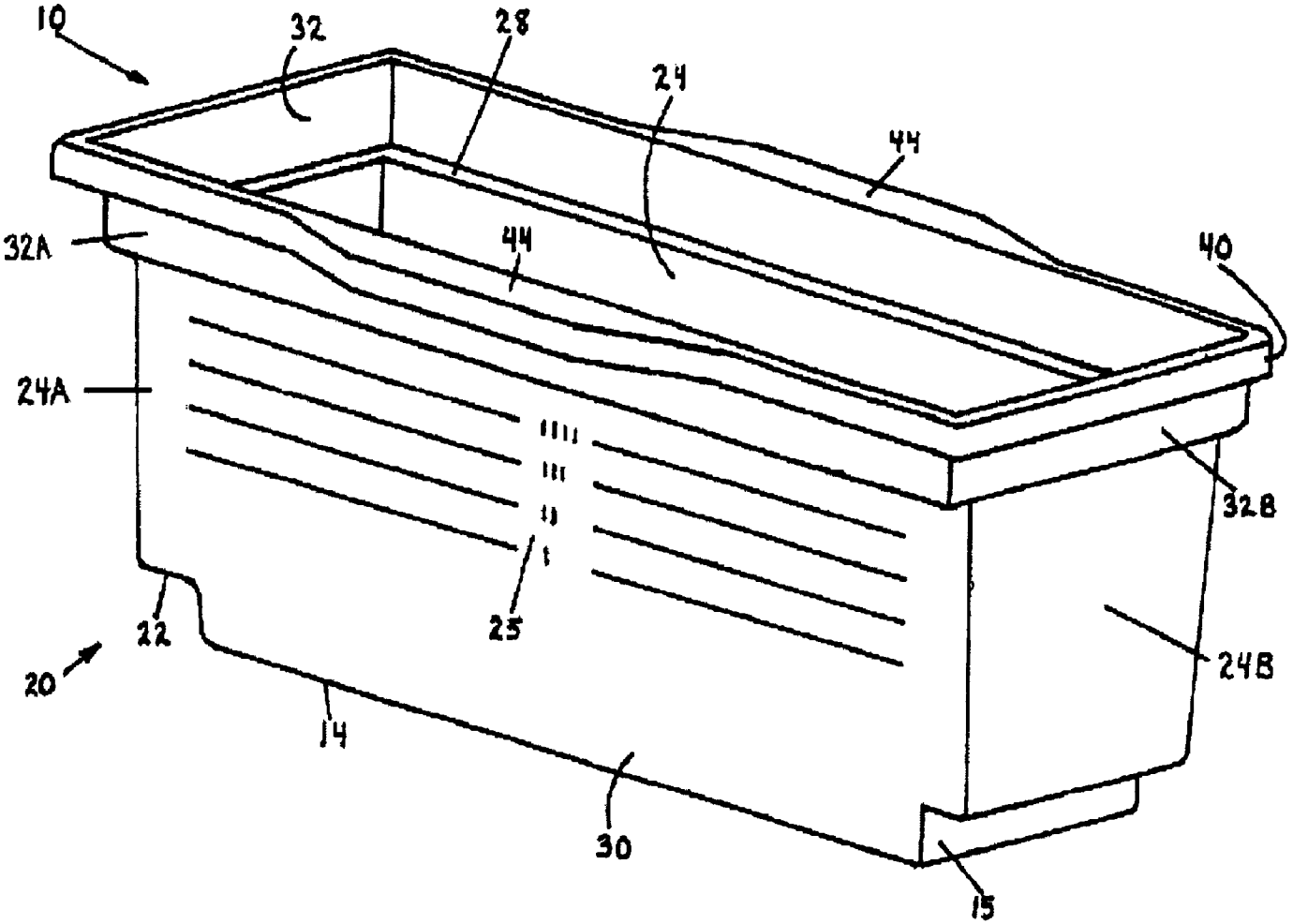
FIG. 1 comprises an three-dimensional isometric view of the container, in accordance with the present invention.
Figure 2:
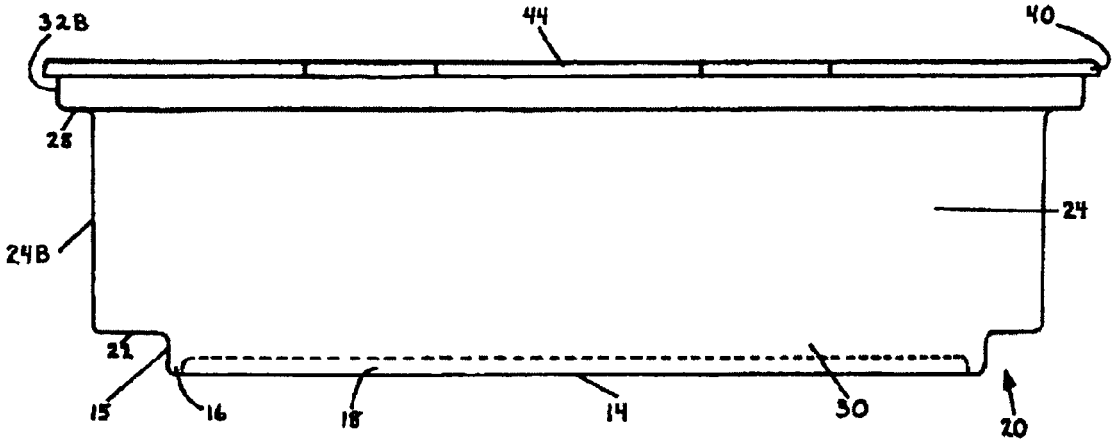
FIG. 2 comprises a side view of the container, in accordance with the present invention.

Referring now to the drawings, wherein the showings are for the purpose of illustrating the invention only and not for the purpose of limiting the same, FIGS. 1, 2, 3, and 4 depict various features of a container 10 for use in a microwave oven device to heat and cook foodstuffs, which has been constructed in accordance with an embodiment of the present invention. Dimensions provided are meant to be illustrative of one embodiment of the concept, and not restrictive.

The container 10 is intended for use in the microwave oven for heating foodstuffs and water contained therein, the foodstuffs including specifically pasta comprising, e.g., commercially prepared lasagna, spaghetti, linguini, and others. The container 10 comprises a base section 20 which is substantially rectangularly shaped and includes a lower ledge 22, and sump 30. There is a first wall 24 including first elongated sides 24A and ends 26A extending upwardly from an outer periphery of the base section 20, forming a cooking chamber 27. An upper ledge 28 is formed annular to the first elongated sides 24A and ends 26A, extending outwardly from a periphery of a top of the first wall 24. There is a second wall 32 including second elongated sides 32A and ends 32B which extend upwardly from a periphery of the outwardly extending upper ledge 28. An outwardly extending flange 40 is formed along a periphery of the second sides, and is preferably exaggerated along at least a portion of the elongated sides to form handles 44. In the embodiment depicted, the base of the container has an inside chamber length of about 27 cm, an inside width of about 6.4 cm, and an inside overall height of about 8.9 cm.

There is a removable lid 50 which is used in conjunction with the container 10 subsequent to heating and cooking of the foodstuffs.

The base 20 is substantially rectangularly shaped with the ends thereof arcuately shaped, concave to and bowing outwardly from the inner portion of the container. The base has a longitudinal length adapted to accommodate elongated pasta foodstuffs that are laid horizontally. The base includes the lower ledge 22, which is substantially horizontal, and, the sump 30. The sump 30, which includes a bottom section 14 and a raised center section 18, is formed beneath the base and preferably has a width slightly less than the base and of a length less than the base, as delineated by sump sides 15. The raised center section 18 comprises a portion of the sump of an increased height relative to the bottom 14. The raised center section 18 is equal to, or, preferably of a height that is less than the lower ledge 22. A channel 16 is created in the sump between the raised center section and outer sides of the sump, formed along the outer periphery of the sump in this embodiment. The lower ledge 22 acts to suspend the elongated pasta over the sump 30 to permit water to completely surround it for more effective cooking. The channel 16 contains a portion of the water in the sump of the base so as to receive microwaves transmitted not only from the top and sides but also from the bottom of the microwave during the heating and cooking process. This provides additional surface area for water to receive microwaves to effect rapid boiling to move the suspended pasta and eliminate any need to stir during the cooking process.

The first elongated sides 24A and ends 26B extend upwardly from an outer periphery of the base to form the cooking chamber 27. The first elongated sides 24A and ends 26B are substantially vertical with each having a slight inward taper from the upper ledge 28 to the base section 20. The first wall 24 preferably include markings 25 indicating recommended water levels for the food preparer to add for the desired portion of pasta being cooked for various portion sizes, from one to four (I-IIII) portions of pasta. More preferably, the markings 25 are located on the elongated first sides 24A. The first ends 26B extend upwardly from the ends of the base section, and are preferably arcuately shaped outwardly from the inner portion of the container so the plane of each of the ends is concave to the inner portion of the container. This is depicted with reference to FIG. 3. The arcuate surface of each of the ends permits flow of water around the edges of the pasta during the cooking process for effective heating and cooking of foodstuffs inserted in the container, and to prevent the ends of the pasta from sticking together.

The upper ledge 28 is formed annular to the first wall 24 and completely around a periphery of a top of the first wall 24, and extends outwardly, in a substantially horizontal plane. The upper ledge 28 and second sides 32 form a spillway 29 above the surface of the water in the container to collect boiling water and foam, which flows back to the container, thus preventing boiling over and out of the container during the heating and cooking process.

The second elongated sides 32A and ends 32B extend upwardly from the outwardly extending upper ledge 28 around its entire periphery. The second elongated sides 32A and ends 32B are substantially vertical. An outwardly extending flange 40 is formed annular to and completely around an upper periphery of the second wall 32. The flange includes a sealing surface 46 around the periphery including handles 44 on the portions of the periphery coinciding with the elongated second sides of the container 10. The upper ledge 28 and the outwardly extending flange 40 including handles 44 provide structurally rigidity to the container 10, limiting and substantially eliminating flexing of the container when being removed from a microwave oven subsequent to heating and cooking. The handles 44 are useful for removing the container from a microwave for post-heating handling, e.g., draining the water from the heated and cooked contents using the lid 50 with incorporated strainer 52.

Figure 4:
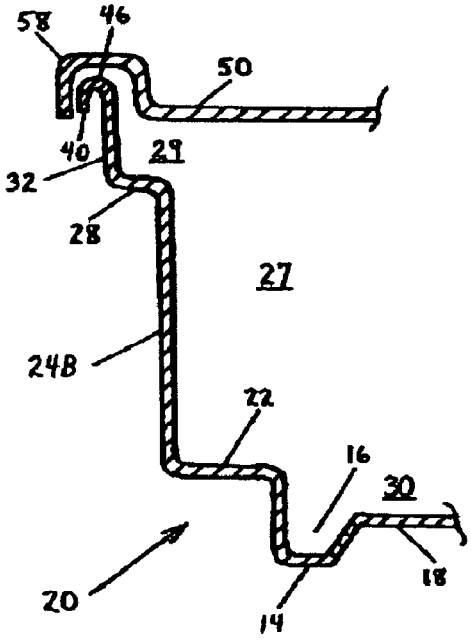
FIG. 4 comprises a partial cut-away side view of the container, in accordance with the present invention.
Figure 5:
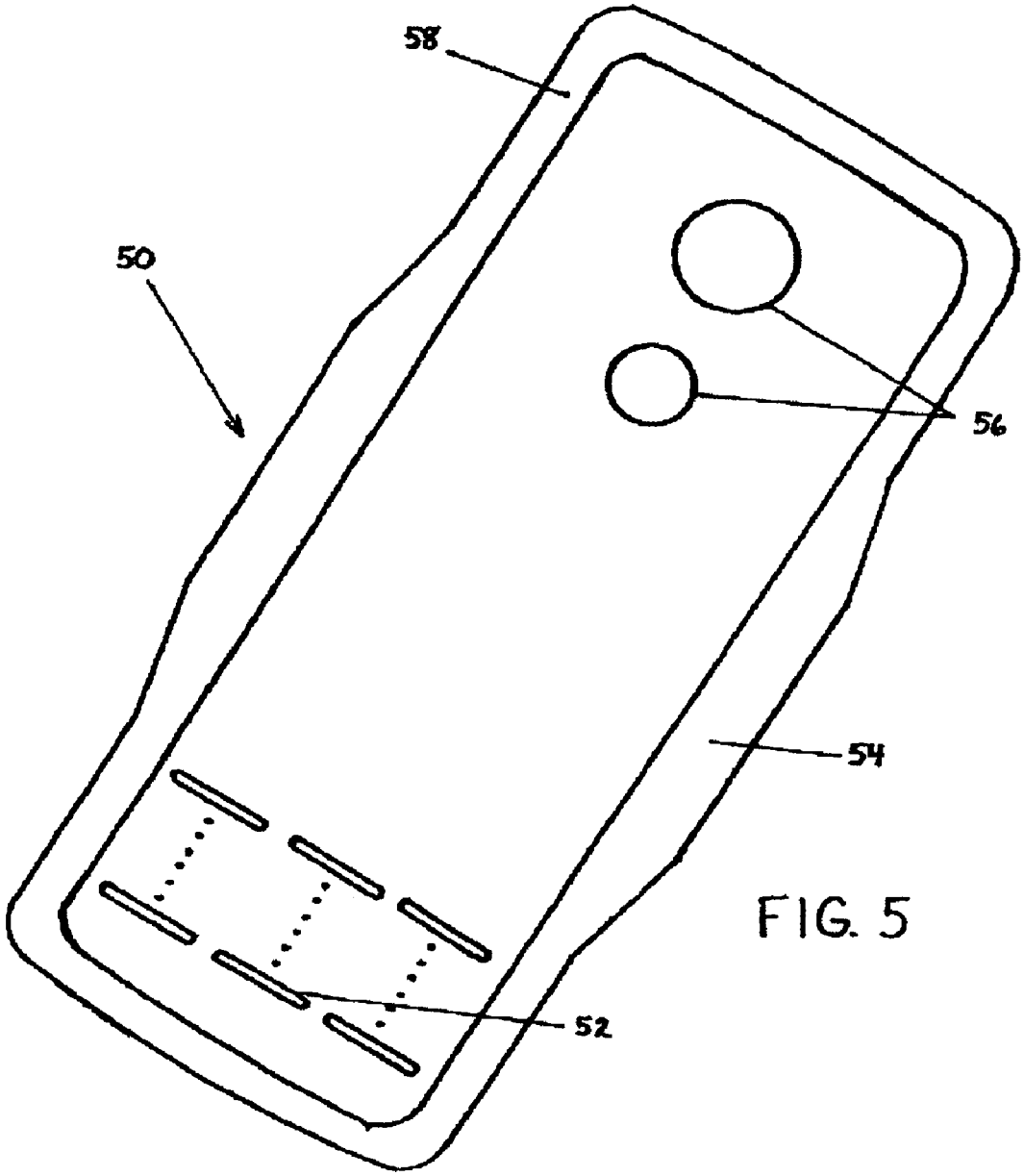
FIG. 5 comprises a top view of a lid for use with the container, in accordance with the present invention.

Referring now to FIGS. 4 and 5, details of the removable lid 50 are now described. The removable lid is substantially planar in shape and covers an open top portion of the container 10. The lid includes an annular sealing surface 58 which fits over the outwardly extending flange 40 of the container. The annular sealing surface 58 has a cross-section that is shaped substantially as an open-ended rectangle, permitting the planar portion of the lid to be below the sealing surface 46 of the outwardly extending flange 40 when in place on the container. When the lid is placed on the container, it pushes residues on the ledge 28 downwardly. The annular sealing surface forms a compressive, substantially watertight seal between the lid and the container 10 when held in place by a food preparer, preferably at lid handles 54 which fit over and seal against container handles 44. There are a plurality of different circular openings 56 in one end of the lid, preferably sized to pre-measure uncooked pasta such as spaghetti, fettuccini and linguini, and other elongated pastas, for accurate and consistent serving portion measurements. The embodiment shown depicts two circular openings, or holes, of pre-determined sizes. The lid includes strainer 52 comprising a plurality of slotted openings which pass through the lid, to permit straining the pasta. The slotted openings are each formed to have straight sides, i.e., a cross-section which has a constant width from the surface of the lid inside the container to the surface of the lid outside the container. Alternatively, the slotted openings can have a cross-section which increases in width from the surface of the lid inside the container to the surface of the lid outside the container, to improve strainability. As depicted, the lid features allow a food preparer to rinse the cooked pasta by adding fresh water through the one of the measuring holes at the one end of the lid and strain the pasta at the opposite end. Alternatively, the removable lid is substantially planar in shape to cover the open top portion of the container 10 but absent slotted or circular openings, for storage.

Figure 6:
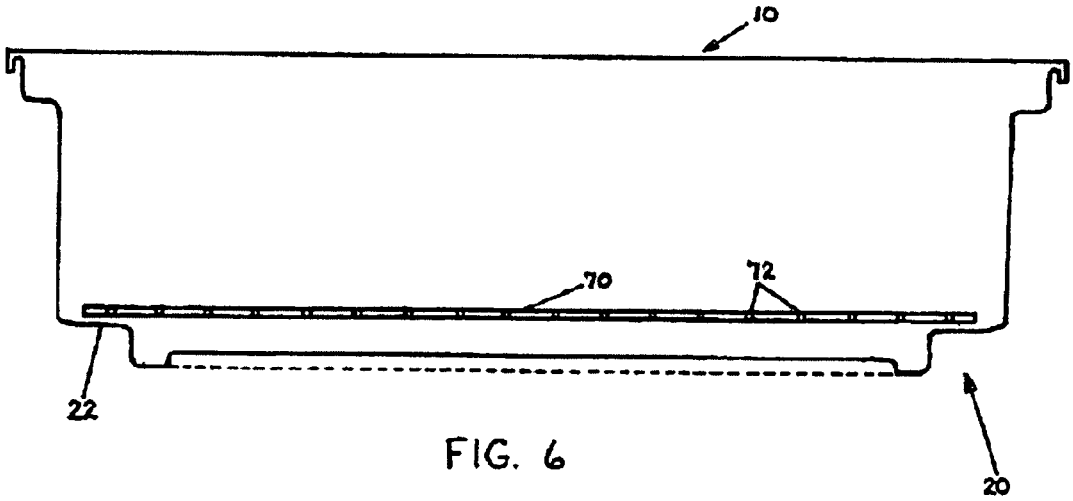
FIG. 6 comprises a cut-away view of a side view of the container, in accordance with the present invention.
Figure 3:
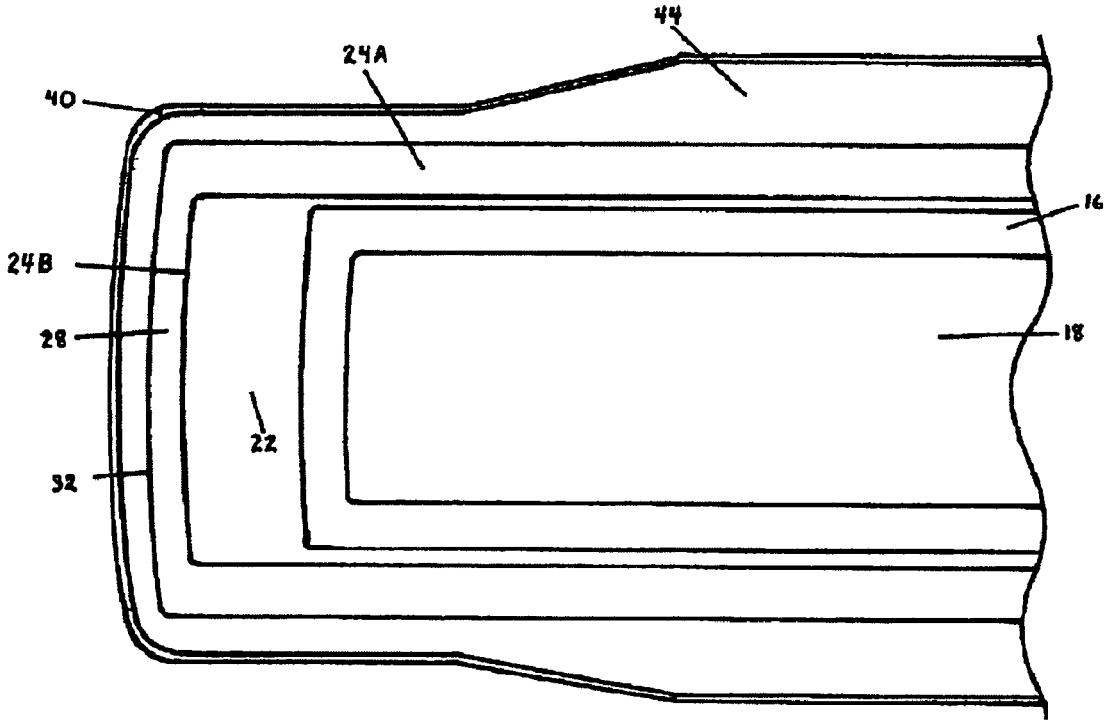
FIG. 3 comprises a partial bottom view of the container, in accordance with the present invention.

Referring now to FIG. 6, there is depicted a side cut-away view of the container. In this view, there is depicted an insert plate 70 which fits within the container at the base 20, and of a length to overlap the lower ledge 22, and of a width which is substantially as wide as the inside portion of the base. The plate includes a plurality of pass-through openings 72 of a small dimension, e.g., 2-5 mm in diameter. The plate is used to permit cooking of short-length pastas such as elbow macaroni.

Figure 7:
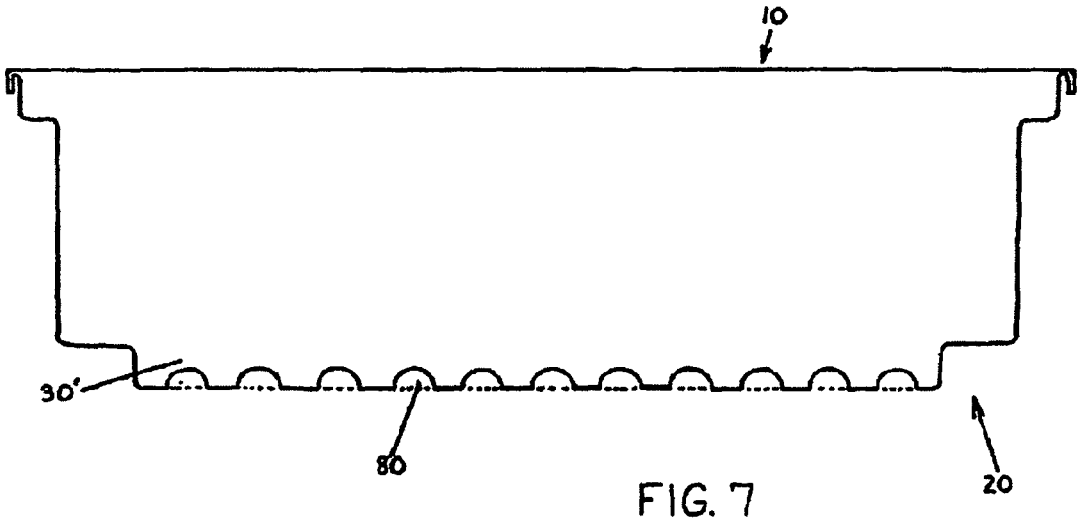
FIG. 7 comprises a side view of an alternative embodiment of the container, in accordance with the present invention; and, FIG. 8 comprises an end view of an alternative embodiment of the container, in accordance with the present invention.

Referring now to FIG. 7, there is depicted a side cut-away view of a first alternate embodiment of the container 10. In this embodiment, the sump 30' includes an undulating bottom portion comprising a plurality of raised sections 80 substantially semi-tubularly shaped and perpendicular to a longitudinal axis of the base, and of a height similar to the height of the raised center section 18 of the first embodiment.

Figure 8:
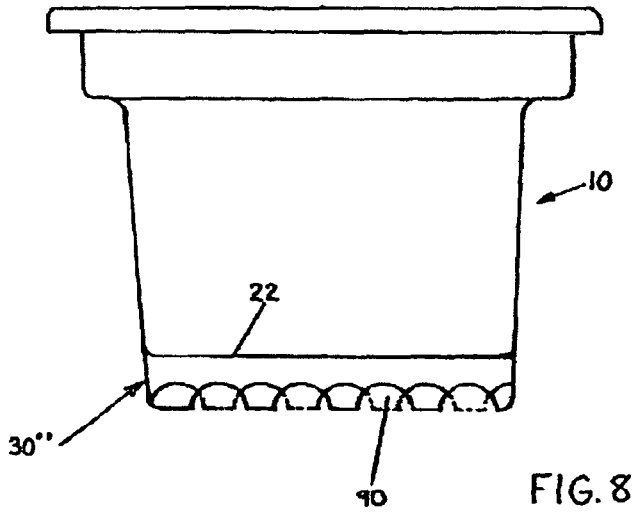

Referring now to FIG. 8, there is depicted an end cut-away view of a second alternate embodiment of the container 10. In this embodiment, the sump 30" includes an undulating bottom portion comprising a plurality of raised sections 90 substantially semi-tubularly shaped and parallel to the longitudinal axis of the base, and of a height similar to the height of the raised center section 18 of the first embodiment.

INDUSTRIAL APPLICABILITY

The container is preferably used for heating and cooking pasta in a microwave oven. The lid is used to measure the pasta prior to cooking and used after the cooking process to drain, strain and rinse the pasta. The lid is not on the container during the cooking process. The container 10, lid 50, and insert plate 70 are preferably constructed of food-grade polypropylene material adapted for microwave heating of foodstuffs, using injection molding processes. Alternatively, the container can be constructed of glass, or another acceptable material. The container 10, lid 50, and insert plate 70 are intended to be cleanable in an automatic dishwasher.

The container is employed to cook elongated pasta noodles such as spaghetti, fettuccine, linguine and lasagna noodles through boiling in water without the need to reduce their standard packaged length prior to heating, e.g. by breaking. The container depicted is designed to contain and boil up to nine dried lasagna noodles in a horizontal position, as not to cause the noodle to be torn or disfigured during the cooking process. The container is also designed to cook up to four adult servings of spaghetti during one cooking cycle. A consistent cooked pasta texture, preferably al dente, is achieved using the predetermined amount of pasta and the predetermined portion of water indicated, cooking for a predetermined period of time.

Preparation of foodstuffs in a microwave oven using the container comprises the following steps. A desired amount of uncooked pasta is measured and placed into the device, per the pasta manufacturer's guidelines for quantities related to servings, up to four servings. Water, and other foodstuffs, e.g. salt and olive oil, are added, the amount of water determined based upon the number of servings and the markings 25 on the sides 24. The filled container, without the lid, is placed in the microwave oven. The oven is set to an appropriate elapsed period of time and heating level, and turned on to heat and cook. Subsequent to the heating and cooking of the foodstuffs, the lid is placed upon the device and it is conveyed out of the microwave using the handles 44 and lid handles 54. The container and lid are then taken to a sink, and the water is drained through strainer 52. The cooked foodstuff is then served, and the container is cleaned.

The embodiments described hereinabove each comprises a container having geometric features with improved microwave cooking properties for all types of dried pasta, resulting in a simplified, faster cooking process as compared to traditional "stove-top" methods of cooking pasta. The container is shaped substantially as an elongated box, of a material specifically designed for cooking all pasta shapes including elongated pasta such as spaghetti and lasagna to be cooked horizontally, completely submerged in water. The container's geometric features improve the efficiency and uniformity of the boil, eliminating a need for a food preparer to monitor or interact during the cooking process. The container incorporates geometric features permitting measurement of a serving amount of uncooked pasta and water to eliminate cooking time variation and eliminate a need for monitoring during the cooking process. The container top has a strainer at the end of the top to strain the water from the pasta and eliminate a need for additional cooking utensils. More simply, this container is usable to microwaveably cook all types of pasta, eliminating any need of other cooking utensils and eliminating any need for the food preparer to interact during the cooking process. The rectangular container has geometric features specifically designed for cooking all types and sizes of pasta, and eliminates human interaction during the cooking process, reduces the time to prepare and cook pasta, and eliminates the cleaning of large cooking utensils. The container permits heating and cooking of elongated pasta such as spaghetti and lasagna noodles without a need of to resize the pasta to fit a pan or container.

The invention has been described with specific reference to the embodiments and modifications thereto. Further modifications and alterations may occur to others upon reading and understanding the specification. It is intended to include all such modifications and alterations insofar as they come within the scope of the invention.

The invention claimed is:

1. A container 10 for preparing pasta food products in a microwave oven, comprising:

a substantially rectangularly shaped base section 20 including a lower ledge 22 and a sump 30 including a raised center section 18 defining a channel 16 along a portion of an outer periphery of the base section wherein the raised center section has a height less than a height of the lower ledge;

a chamber 27 defined by first elongated sides 24A and ends 24B extending upwardly from a periphery of the base section, the chamber substantially separated from the base section by insertion of elongated pasta food products;

an upper ledge 28 annularly formed at a periphery at a top of the first elongated sides and ends extending outwardly therefrom and including second elongated sides 32A and ends 32B extending upwardly from a periphery of the upper ledge; and an outwardly extending flange formed annular to a periphery defined by the second elongated sides and ends.

2. The container of claim 1, further comprising the outwardly extending flange including handles 44 formed thereto.

3. The container of claim 1, further comprising the outwardly extending flange having a sealable surface 46.

4. The container of claim 3, wherein the outwardly extending flange accommodates a removable lid 50.

5. The container of claim 4, further comprising the removable lid substantially planar in shape and including an annular portion 58 which conforms to the outwardly extending flange and compressively seals against the sealable surface.

6. The container of claim 5, wherein the removable lid includes a strainer 52 comprising a plurality of pass-through openings.

7. The container of claim 1, wherein the raised center section of the sump includes an undulating surface 80, 90.

8. The container of claim 1, further comprising an insert plate 70 comprising a substantially fiat tray containing perforations 72 therethrough and insertable within the container and suspendable on the lower ledge.

9. The container of claim 1, wherein at least one of said first elongated sides 24A and ends 24B includes water/portion level markings 25.

10. The container of claim 1, wherein an inner area defined by the base section is of a length and a width accommodating to elongated flat food products horizontally inserted therein.

11. The device of claim 1, wherein the first ends each comprise an arcuate planar surface.

12. The device of claim 11, wherein the upper ledge comprises a spillway 29 configured to collect foam and boiling water in the microwave oven.

13. A method for preparing elongated pasta foodstuffs in a microwave oven, comprising:

forming a water-holding container 10 including a base section 20 and a chamber 27 and a spillway 29; the base section including a lower ledge 22 and a sump 30 including a raised center section 18 defining a channel 16 along a portion of a periphery of the base section wherein the raised center section has a height less than a height of the lower ledge, the chamber comprising first elongated sides 24A and ends 24B extending upwardly from the periphery of the base section, the spillway comprising an upper ledge 28 annularly formed at a periphery at a top of the fast elongated sides and ends extending outwardly therefrom;

separating the base section from the chamber by inserting the elongated pasta foodstuffs into the chamber resting on the lower ledge of the base section;

inserting water into the container;

placing the container in the microwave oven; and operating the microwave oven for a predetermined elapsed period of time.

14. The method of claim 13, wherein inserting the elongated pasta foodstuffs into the chamber comprises inserting a selected amount of the elongated pasta foodstuffs into the chamber.

15. The method of claim 13, wherein inserting the water into the container comprises inserting a predetermined amount of water into the container, the amount of water proportional to the selected amount of the elongated pasta foodstuffs inserted into the chamber based upon a water/portion marking 25 on the container.

16. The method of claim 13, comprising collecting foam and boiling water on the spillway during the operating of the microwave oven with the container placed therein.

* * * * *